US008074718B2

(12) United States Patent
Roberts

(10) Patent No.: US 8,074,718 B2
(45) Date of Patent: Dec. 13, 2011

(54) BALL SEAT SUB

(75) Inventor: William M. Roberts, Tomball, TX (US)

(73) Assignee: Smith International, Inc., Houston, TX (US)

( * ) Notice: Subject to any disclaimer, the term of this patent is extended or adjusted under 35 U.S.C. 154(b) by 258 days.

(21) Appl. No.: 12/572,062

(22) Filed: Oct. 1, 2009

(65) Prior Publication Data

US 2010/0084146 A1 Apr. 8, 2010

Related U.S. Application Data

(60) Provisional application No. 61/103,862, filed on Oct. 8, 2008.

(51) Int. Cl.
*E21B 34/00* (2006.01)

(52) U.S. Cl. ..... 166/332.3; 166/373; 166/319

(58) Field of Classification Search ..... 166/334.2, 166/318, 329; 175/234, 235, 237, 202, 207, 175/218; 137/519.5
See application file for complete search history.

(56) References Cited

U.S. PATENT DOCUMENTS 4,254,836 A * 3/1981 Russell ..... 175/65
5,553,672 A * 9/1996 Smith et al. ..... 166/382
6,866,100 B2 * 3/2005 Gudmestad et al. ..... 166/316

OTHER PUBLICATIONS

Combined Search and Examination Report issued in related British Application No. GB0917654.6; dated Nov. 30, 2009 (6 pages).

* cited by examiner

*Primary Examiner* — Kenneth L Thompson
*Assistant Examiner* — Ronald Runyan
(74) *Attorney, Agent, or Firm* — Rodney Warfford; Tim Curington

(57) ABSTRACT

A downhole tool for providing a pressure differential between sub-assemblies, the downhole tool including an elongated body, a tubular assembly disposed within the elongated body, the tubular assembly including a central flowbore with an inner diameter and a central longitudinal axis, a camming device, an actuator member located below the tubular assembly, having a dual-bore configuration, the actuator member including a first bore, a second bore, and a concave seating surface formed within the second bore for receiving a obstructing device, wherein the first bore and the second bore are oriented 90 degrees to one another so that fluid may flow through the actuator while it is in either a first or a second position, and a stationary sleeve concentrically disposed between the actuator member and the elongated body is disclosed.

20 Claims, 5 Drawing Sheets

BALL SEAT SUB

CROSS-REFERENCE TO RELATED APPLICATIONS

This application, pursuant to 35 U.S.C. §119(e), claims priority to U.S. Provisional Application Ser. No. 61/103,862, filed Oct. 8, 2008. That application is incorporated by reference in its entirety.

BACKGROUND OF INVENTION

1. Field of the Invention

Embodiments disclosed herein relate to downhole tools, particularly setting tools for hydraulic liners and other hydraulic actuated devices. More specifically, embodiments disclosed herein relate to setting tools that actuate hydraulic liner hangers in deviated wellbores.

2. Background Art

Typically, liners are used below casing in wellbores to extend the length of the casing. A liner is a section of smaller casing that is suspended downhole in existing casing. In most cases, the liner extends downwardly into an open hole and overlaps the existing casing by approximately 200-400 ft. In certain application, the liner may be cemented in place. A conventional liner hanger is used to attach or hang liners from the internal wall of a casing segment. Hydraulic liner hangers have been preferred by operators in deviated wellbores over mechanical liner hangers. This is because deviation of the wellbore makes it less certain that the mechanical hanger mechanism will be properly actuated in a deviated wellbore. In this instance hydraulic liners provide advantages over mechanical hangers, because hydraulic hangers may not require mechanical movement of the pipe or tubular.

In conventional designs, the liner with a setting tool is lowered into position, and pressure within the setting tool is used to set the hydraulic liner hanger through a lateral port therein. In some designs, the flow passage through the setting tool is obstructed at its lowermost end so the applied pressure in the setting tool properly reaches the hydraulic liner hanger. Other designs place the obstruction for the setting tool near the bottom of the liner to allow a cement wiper plug to pass completely through the liner to remove residual cement therefrom. If the residual cement is not removed, cutting or grinding operations may be required to remove excess cement within the liner.

Some aspects of using a conventional setting tool may lengthen the time required to complete the placement and cementing of a liner. In addition to an increase in completion time, other setting tool designs are subject to inadvertent damage within the tool. For example, collet-type valve seats have been used in applications where the drop ball seats on relatively short upwardly directed collet fingers, thus compressing the collet fingers when the ball is seated. A shear pin release permits a shift of the fingers to a location where the collet fingers are expanded to release the ball member. The collet fingers are typically short, thereby preventing the compressive forces from damaging them. (The design, thus, requires that the fingers have little resilience and prevents them from fully expanding unless a large diameter ball is used. In addition to damaging the tool, using a large diameter ball raises the possibility of prematurely actuating a wiper plug upon release.) A collet mechanism is also prone to damaging fins of a pump-down plug or dart by folding the fins backwards as they pass through the unsupported slots of the collet. Additionally, fluid cuts as it passes around the fins and through the slots.

In a system where the end of the liner with a setting tool is located in a non-vertical location, such as a deviated or horizontal section of well bore, other problems arise. In these instances it can be extremely difficult, and sometimes not possible, to obtain seating of a ball or an obstructing device in a small, centrally located valve seat opening at the lower end of a liner. In such a design, the valve seat has a convex upper surface, as shown in, for example, U.S. Pat. No. 5,553,672. In this design, as the ball rolls along the inner diameter of the tool, gravity may move the ball into a dead fluid area that is adjacent to the seat. In order to seat the drop ball, the ball must be lifted off of the low side of the tool and moved to the center of the valve with the fluid flow. This process can be time constraining and difficult to accomplish.

Accordingly, there exists a need for a setting tool that provides a pressure differential for actuating downhole tools that includes an improved ball valve assembly.

SUMMARY OF INVENTION

In one aspect, embodiments disclosed herein relate to a downhole tool for providing a pressure differential between sub-assemblies, the downhole tool including an elongated body, a tubular assembly disposed within the elongated body, the tubular assembly including a central flowbore with an inner diameter and a central longitudinal axis, a camming device, an actuator member located below the tubular assembly, having a dual-bore configuration, the actuator member including a first bore, a second bore, and a concave seating surface formed within the second bore for receiving a obstructing device, wherein the first bore and the second bore are oriented 90 degrees to one another so that fluid may flow through the actuator while it is in either a first or a second position, and a stationary sleeve concentrically disposed between the actuator member and the elongated body.

In another aspect, embodiments disclosed herein relate to a method of operating a downhole tool for providing a pressure differential between sub-assemblies, the method including running a downhole setting tool to a desired location in a wellbore, the downhole tool including an elongated body, a tubular assembly disposed within the elongated body, the tubular assembly further including a central flowbore with an inner diameter, and a central longitudinal axis, a camming device, an actuator member having a dual-bore configuration, the actuator member further including a first bore, a second bore, a concave seating surface formed within the second bore for receiving an obstructing device, and a stationary sleeve disposed between the actuator member and the elongated body, wherein the actuator member is aligned axially in a first position and located below the tubular assembly, circulating a fluid through the central flowbore, disposing the obstructing device into the fluid, wherein the fluid guides the obstructing device into the seating surface, and providing a pressure differential between an upper sub and a lower sub to activate the downhole tool.

Other aspects and advantages of the invention will be apparent from the following description and the appended claims.

DETAILED DESCRIPTION

Embodiments disclosed herein may provide a downhole tool for creating a pressure differential between two sub-assemblies. In particular, a downhole tool having a dual-bore configuration that restricts flow of a fluid through a first bore when the downhole tool is in a closed position, and allows fluid flow through a second bore when the tool is in an open position is disclosed. As used herein, the closed position may refer to a positioning of components in the downhole tool wherein fluid flow through the downhole tool is restricted or prevented. The downhole tool includes a camming device configured to rotate an actuator member to align one of the first and second bores with a central bore of the downhole tool. The pressure differential between sub-assemblies is achieved by dropping a restricting device into the first bore. When desired, the downhole tool is activated by increasing a downhole pressure until it exceeds a pre-determined value. Once the downhole tool is activated, the actuator member is rotated to the open (full-bore) position. In the open position, a full-bore diameter fluid flow may be reestablished and other downhole tools may be passed through the downhole tool.

Figure 1:
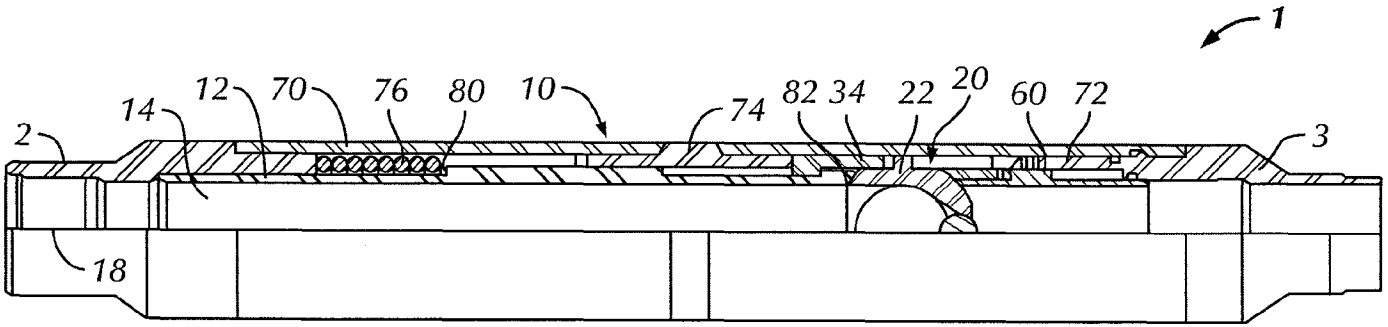
FIG. 1 is a partial cross-sectional side-view of a downhole tool in accordance with embodiments of the present disclosure.

Referring initially to FIG. 1, a downhole tool 1 in accordance with the present disclosure is shown. The downhole tool 1 may be used to provide a pressure differential between an upper subassembly 2 and a lower subassembly 3. The downhole tool 1 includes an elongated body 10 and a tubular assembly 12 disposed within the elongated body 10. The elongated body 10 may include a first cylindrical housing 70, and a second cylindrical housing 72. In this embodiment, the elongated body 10 may include a coupler 74 that couples the first cylindrical housing 70 to the second cylindrical housing 72. The downhole tool 1 may also include an energizer 76, such as a biased spring. As shown, the energizer 76 may be disposed concentrically between the first cylindrical housing 70 and a portion of the tubular assembly 12, and in contact with a lower portion of an upper sub 2.

Figure 2:
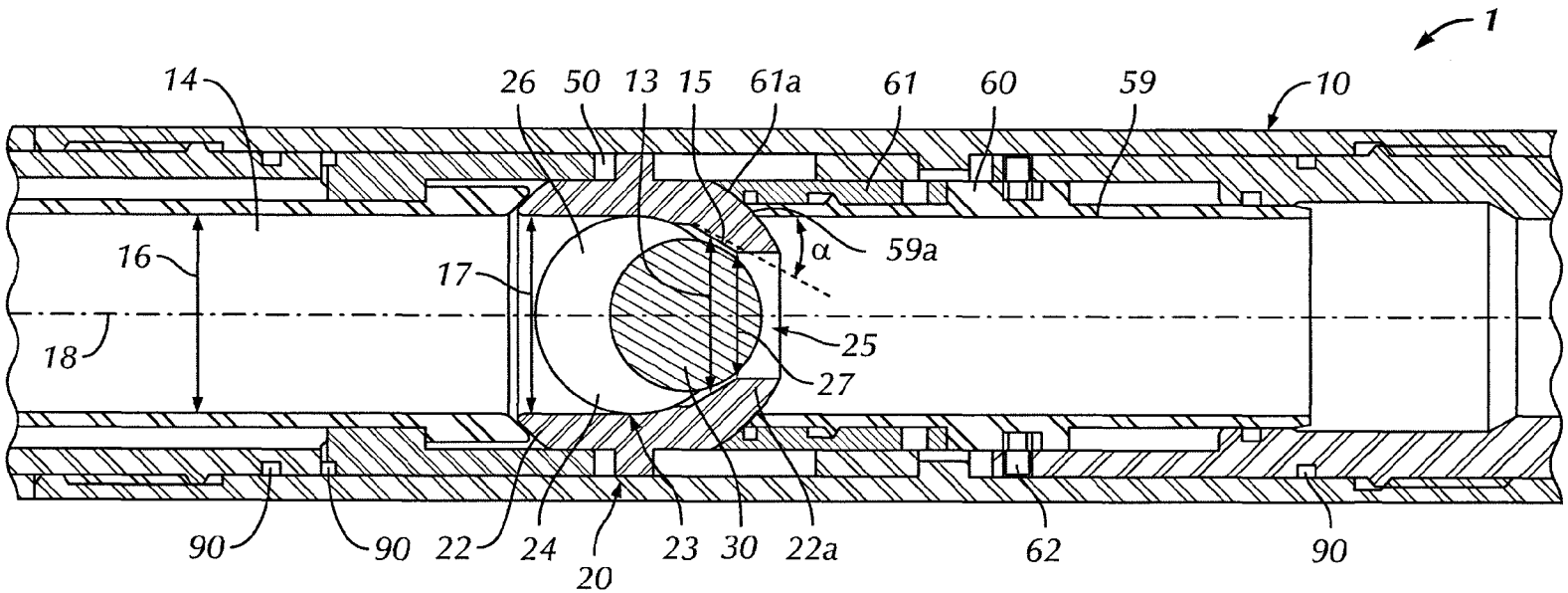
FIG. 2 is a cross-sectional view of an actuator member in accordance with embodiments of the present disclosure.

Referring to FIGS. 1 and 2, the tubular assembly 12 includes a central flowbore 14 having an inner diameter 16 and a central longitudinal axis 18. One of ordinary skill in the art will appreciate that the size of the inner diameter 16 of the central flowbore 14 may vary based on, for example, the size and orientation of the wellbore, the size of components run through the central flowbore 14, desired flow rate of fluid through the downhole tool, etc. In certain embodiments, the inner diameter 16 of the downhole tool may be between 1 and 4 inches.

An actuator member 22 is disposed below tubular assembly 12 and configured to rotate from a first position to a second position within the downhole tool 1. A shoulder 82 formed on the lower end of tubular assembly 12 contacts an upper end of actuator member 22. Actuator member 22 has a dual-bore configuration and includes a first bore 26 and a second bore 24, wherein the first bore 26 and the second bore 24 are misaligned. In particular, in one embodiment, the first bore 26 may be perpendicular to the second bore 24. More specifically, the first bore 26 and the second bore 24 may be longitudinally aligned but oriented at 90 degrees to each other.

Referring to FIG. 2, the first bore 26 has a first inner diameter 17 substantially equal to inner diameter 16 of tubular assembly 12 and a second inner diameter 27 that is less than the inner diameter 16 of tubular assembly 12. Thus, the first bore 26 may be referred to as a restricted bore. The second bore 24 has an inner diameter 23 substantially equal to the inner diameter 16 of the central flowbore 14 of tubular assembly 12. Thus, second bore 24 may be referred to as a full bore. The actuator member 22 may be positioned within the tubular assembly 12 in the closed position, wherein the first bore 26, or restricted bore, is aligned with the central flowbore 14, such that fluid flow through the downhole tool 1 is restricted or prevented (i.e., when a drop ball is seated within the actuator member 22, as described in more detail below). Alternatively, the actuator member 22 may be positioned within the tubular assembly 12 in the open position, wherein the second bore 24 is aligned with the central flowbore 14, such that full-bore fluid flow is allowed through the downhole tool 1.

The first bore 26, or restricted bore, includes a transition inner diameter 13 which tapers inward from the first inner diameter 17 to the second inner diameter 27 at an angle $\alpha$. In one embodiment, the angle $\alpha$ may be in the range of 0 to 60 degrees. In certain embodiments, angle $\alpha$ may be 30 degrees. In some embodiments, the transition inner diameter 13 may be a concave surface sloping inwardly from the first inner diameter 17 to second inner diameter 17. In certain embodiments, the transition inner diameter 13 of first bore 26 may provide a conical surface. A throat 25, or narrowed portion of the first bore 26 having the second inner diameter 27, is formed in a lower portion of the first bore 26. The throat 25 restricts fluid flow through the downhole tool 1. A ball seat 15 is provided by the throat 25 and transition inner diameter 13 of first bore 26. The ball seat 15 includes a concave surface configured to receive and seat an obstructing device 30. In one embodiment, the ball seat 15 may be a conical surface configured to receive and seat the obstructing device 30. When the obstructing device 30, or drop ball, is carried into the downhole tool 1 by the fluid flow, the drop ball 30 moves into the actuator member 22, and seats in the ball seat 15. The concave surface of the ball seat 15, formed by the transition inner diameter 13 and throat 25 of the first bore 26, guides the drop ball 30 in position for proper seating in the ball seat 15. A concave or conical surface allows for obstructing devices 30 of various sizes to be used. Additionally, the concave surface of the ball seat 15 helps maintain the proper positioning of the drop ball 30 in deviated wells and horizontal wells.

Fluid pressure may be applied above the drop ball 30 to facilitate the pressure actuation of downhole tools, such as liner hangers or packers.

The second bore 24 is a substantially full-bore, such that fluids and other devices may pass unimpeded through the downhole tool 1 when the actuator member 22 is rotated to the open position (i.e., when the second bore 24 is aligned with the central flowbore 14). Actuator member 22 may be rotated within downhole tool 1 by a camming device 20, described in more detail below. Spherical seats (not shown) may be provided on surfaces adjacent to the actuator member 22 to direct fluid flow through the actuator member 22. In one embodiment, the spherical seats (not shown) may be formed from a hard material, such as metal. Alternatively, a "soft seal" may be provided by an elastomer (e.g., o-ring) that seals against a lower face of the actuator member 22.

Figure 3:
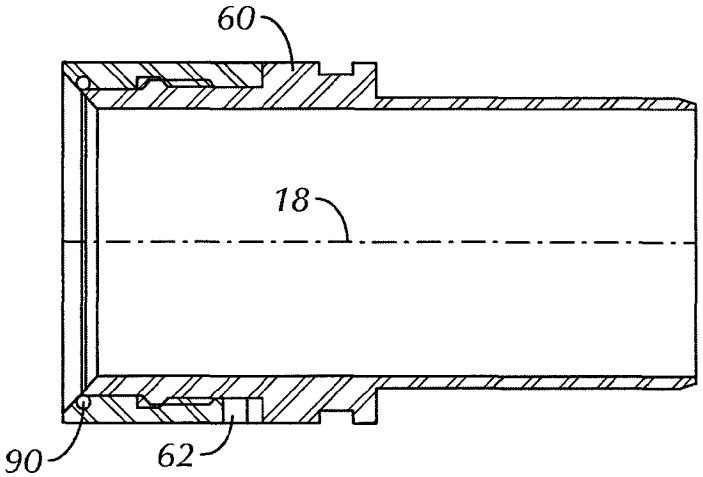
FIG. 3 is a cross-sectional view of a sliding sleeve assembly in accordance with embodiments of the present disclosure.
Figure 4B:
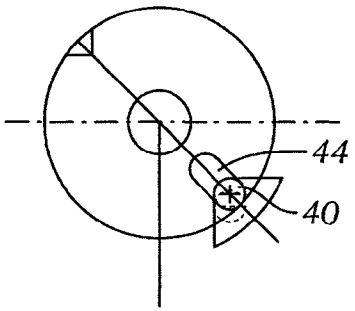
FIG. 4B is a side view of the actuator member and camming device of FIG. 4A in accordance with embodiments of the present disclosure
Figure 4A:
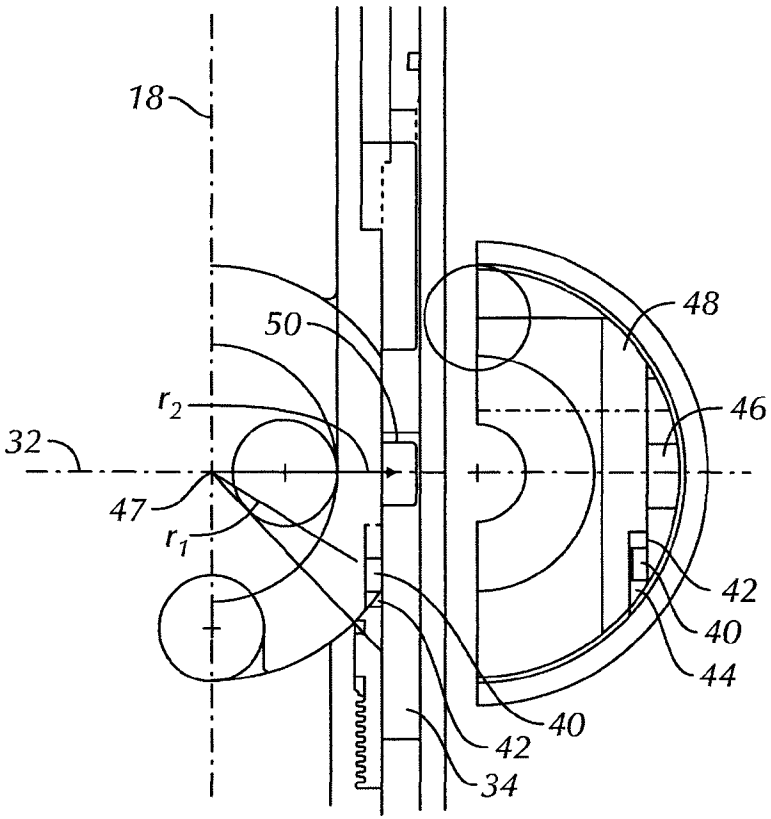
FIG. 4A is a cross-sectional view of an actuator member and a camming device in accordance with embodiments of the present disclosure.

Downhole tool 1 may also include a sliding sleeve assembly 60 (shown in more detail in FIG. 3) disposed within the elongated body 10 and at least partially located below the actuator member 22. A frangible connection 62 secures the sliding sleeve assembly 60 in place to maintain the actuator member 22 in a first, or closed, position. The frangible connection 62 may be, for example, shear screws or any other frangible connection known to a person of ordinary skill in the art. Alternatively, the frangible connection 62 may be a shearing device configured to shear by hydraulic activation. For example, the shearing device may be a shear screw having a pre-determined shear force, such that the shear screw may shear when the applied pressure exceeds a specific value. In another example, the shear screw may shear when the pressure applied is between 300 and 4,000 psi.

As shown in FIG. 2, the sliding sleeve assembly 60 may include a lower section 59 coupled to an upper section 61 by any means known in the art, such as, threaded engagement, welding, bolting, etc. The sliding sleeve assembly 60 may be configured such that an upper end 59*a* of the lower section 59 and an upper end 61*a* of the upper section 61 are both in contact with a lower surface 22*a* of the actuator member 22. The sliding sleeve assembly 60 may support or maintain the actuator member 22 in the closed position. Additionally, multiple o-rings 90 may be disposed within the tool for providing seals between various components.

Referring to FIGS. 2, 3, 4A, and 4B, the downhole tool 1 may also include a stationary sleeve 34 concentrically disposed between the actuator member 22 and the elongated body 10. In one embodiment, the stationary sleeve 34 may be a control arm. The camming device 20 engages the actuator member 22 with the stationary sleeve 34. The camming device 20 may include a plurality of inwardly facing camming pins 40 disposed on an inner surface 42 of the stationary sleeve 34. The camming pins 40 may be located oppositely from one another at an equal radial distance $r_1$ from a point on the central longitudinal axis 18. The camming device 20 may also include a plurality of corresponding cam slots 44 disposed on an outer surface the actuator member 22 for slidably engaging the plurality of camming pins 40, and a plurality of outwardly facing protrusions 46 oppositely disposed on an exterior 48 of the actuator member 22. The protrusions 46 may be located at an equal radial distance $r_2$ from a center point 47 along an axis of rotation 32. The camming device 20 may include a plurality of holding grooves 50 disposed within the stationary sleeve 34 for mating with the protrusions 46. During actuation of the actuator member 22, the protrusions 46 may be maintained within the holding grooves 50, such that the actuator member 22 may translate axially downward. The actuator member 22 may further include a mechanical stop to prevent the actuator member 22 from over-rotating during actuation.

Figure 5:
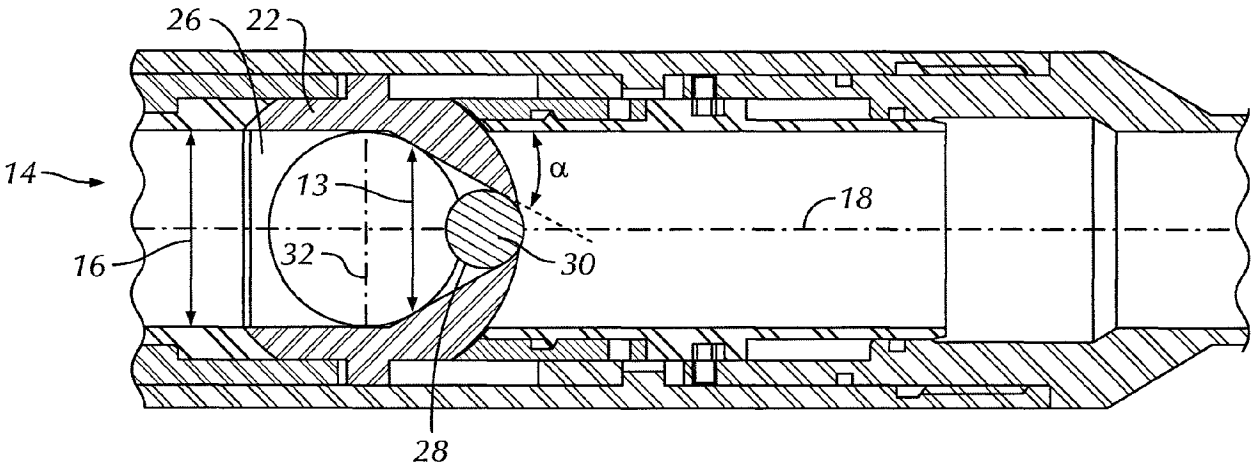
FIG. 5 is a cross-sectional view of the actuator member in a first position in accordance with embodiments of the present disclosure.
Figure 6:
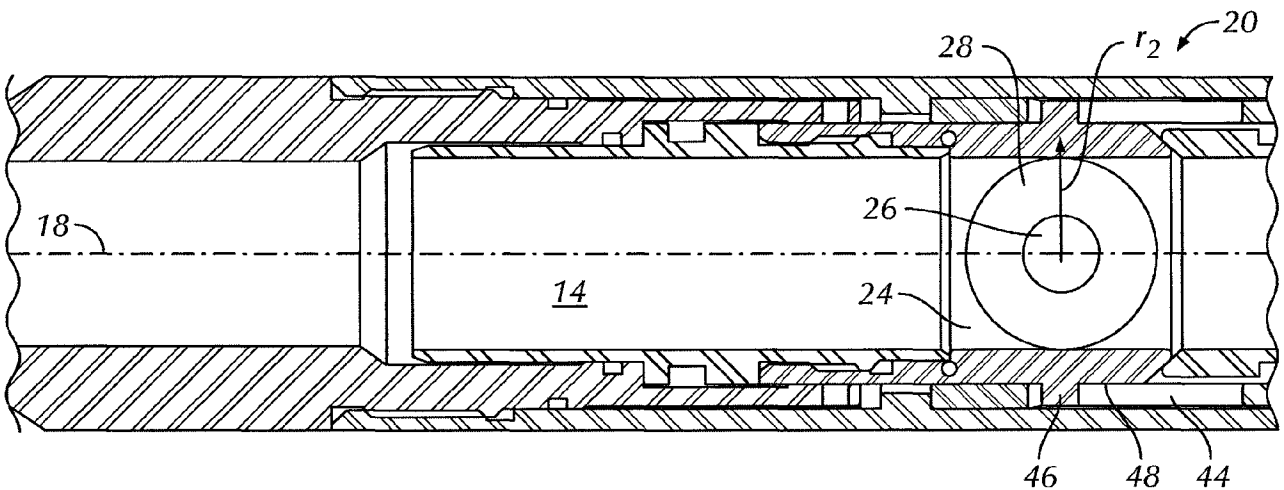
FIG. 6 is a cross-sectional view of the actuator member in a second position in accordance with embodiments of the present disclosure.

Referring now to FIGS. 5 and 6, the downhole tool 1 is shown in closed and open positions, respectively. When the downhole tool 1 is lowered into the wellbore (not shown), the actuator member 22 is oriented in the closed position (FIG. 5). Thus, the first bore 26 is aligned with the central flowbore 14. Fluid is provided through the central flowbore 14 of the downhole tool 1. When actuation of a downhole mechanism, for example, a liner hanger, is desired, an obstructing device 30 (i.e., a drop ball) may be provided in the fluid flow. In certain embodiments, the obstructing device 30 may include one or more drop balls. The fluid flow may be in a range of between 1 and 15 bbls/min; however, one of ordinary skill in the art will appreciate that other flow rates may be used depending on the particular application. When actuation is desired, fluid flow carries the obstructing device 30 into the actuator member 22, wherein the obstructing device 30 is seated in the ball seat 28. The concave surface provided by the transition inner diameter 13 guides the obstructing device 30 into position in the restricted lower portion of first bore 26 of actuator member 22 and maintains the obstructing device in position during actuation of other hydraulically actuated mechanisms. The seated obstructing device 30 prevents the flow of fluid through the downhole tool 1. Accordingly, a pressure differential between the upper assembly (not shown) and the lower assembly (not shown) is created. Fluid may then flow upward and into channels (not shown) for providing fluid flow to hydraulically actuated mechanisms (e.g., a liner hanger).

After actuation of at least one other hydraulic mechanism, fluid flow through the central flowbore 14 may be restored by activation of actuator member 22. The actuator member 22 may be hydraulically activated by increasing the fluid pressure above the actuator member 22 acting on the obstructing device 30 and the concave surface of the ball seat 28. The pressure differential created by the restricted fluid flow across the actuator member 22 provides a force on the sliding sleeve assembly 60. When the force on the sliding sleeve assembly exceeds the predetermined value, or shear value, of the frangible connection 62, the frangible connection 62 breaks. For example, in the embodiment where the frangible connection 62 includes at least one shear pin, the shear pins shear when the force acting on the sliding sleeve assembly 60 exceeds the shearing strength of the at least one shear pin. When the frangible connection 62 is broken, the sliding sleeve assembly 60 moves downwardly, thereby allowing the actuator member 22 to move downward and rotate due to engagement of the camming device 20. As the actuator member 22 moves downwardly, it rotates from the first, closed, position, to the second, open, position (FIG. 6).

The camming device 20 causes the actuator member 22 to rotate from the first position (FIG. 5) to the second position (FIG. 6) around an axis of rotation 32 perpendicular to the central longitudinal axis 18. When corresponding camming slots (44 in FIG. 4A) of the actuator member 22 engage camming pins (40 in FIG. 4A), a torque is imparted to the actuator member that causes it to rotate 90 degrees from the closed position to the open position. The stop mechanism (not shown) is placed a selected distance from the center of rotation of the actuator member 22 approximately equal to a distance of the camming pins (40 in FIG. 4A) from the center of rotation of the actuator member 22. Further, stop mechanism (not shown) may be positioned between 45 degrees and 180 degrees from the camming slots (44 in FIG. 4A) to prevent over-rotation of the main ball and obstruction of the bore.

The energizer (76 in FIG. 1) may exert a downward force upon the shoulder (80 in FIG. 1) of the tubular assembly 12 to maintain the actuator member 22 in the second position once the actuator member 22 has rotated, thereby providing full-bore flow through the downhole tool 1.

Figure 7:
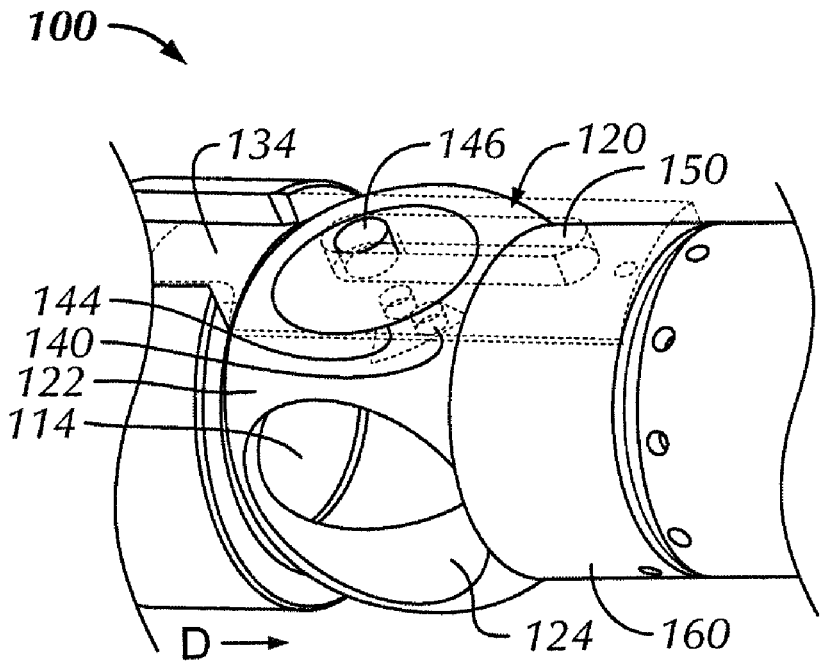
FIG. 7 is a perspective view of an actuator member and camming device in a first position in accordance with embodiments of the present disclosure.
Figure 8:
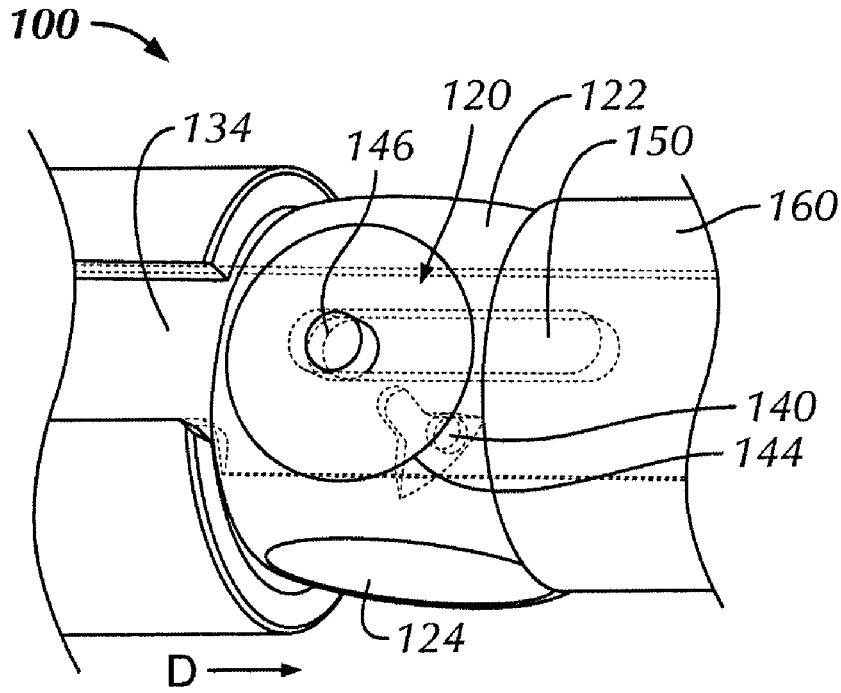
FIG. 8 is a close-up perspective view of the actuator member and camming device of FIG. 7.

Referring now to FIGS. 7-10, perspective views of an actuator member and corresponding camming device of a downhole tool formed in accordance with embodiments of the present disclosure are shown. Referring initially to FIGS. 7 and 8, actuator member 122 is shown in a first position (i.e., closed position). In the first position, a first bore (126 in FIG. 9), or restricted bore, is aligned with the central flowbore 114, such that fluid flow through the downhole tool 100 is restricted or prevented (i.e., when a drop ball is seated within the actuator member 122, as described in detail above). Actuator member 122 may be rotated within downhole tool 100 from the first position to a second position (i.e., open position) by a camming device 120. In the second position, a second bore 124 is aligned with the central flowbore 114, such that full-bore fluid flow is allowed through the downhole tool 100.

Downhole tool 100 may also include a sliding sleeve assembly 160 at least partially located below the actuator member 122. A frangible connection (not shown) secures the sliding sleeve assembly 160 in place to maintain the actuator member 122 in the first, or closed, position. The downhole tool 100 may also include a stationary sleeve 134 concentrically disposed between the actuator member 122 and an elongated body (not shown). In one embodiment, the stationary sleeve 134 may be a control arm. The camming device 120 engages the actuator member 122 with the stationary sleeve 134. The camming device 120 may include a plurality of inwardly facing camming pins 140 disposed on an inner surface of the stationary sleeve 134. The camming device 120 may also include a plurality of corresponding cam slots 144 disposed on an outer surface of the actuator member 122 for slidably engaging the plurality of camming pins 140, and a plurality of outwardly facing protrusions 146 oppositely disposed on an outer surface of the actuator member 122. Further, the camming device 120 may include a plurality of holding grooves 150 disposed within the stationary sleeve 134 for mating with the protrusions 146. During actuation of the actuator member 122, the protrusions 146 may be maintained within the holding grooves 150, such that the actuator member 122 may translate axially downward (indicated by directional arrow D). The actuator member 122 may further include a mechanical stop (not shown) to prevent the actuator member 22 from over-rotating during actuation.

Still referring to FIGS. 7-10, when the downhole tool 100 is lowered into the wellbore (not shown), the actuator member 122 is oriented in the first position (FIGS. 7 and 8). Thus, the first bore 126 is aligned with the central flowbore 114. Restricted fluid may then be provided through the central flowbore 114 of the downhole tool 100. When actuation of a downhole mechanism, for example, a liner hanger, is desired, an obstructing device (i.e., a drop ball, not shown) may be provided in the fluid flow. In certain embodiments, the obstructing device 30 may include one or more drop balls. The fluid flow carries the obstructing device (not shown) into the actuator member 122, wherein the obstructing device (not shown) is seated in the ball seat (not shown). A concave surface of the ball seat (not shown) guides the obstructing device (not shown) into position in the restricted lower portion of first bore 126 of actuator member 122 and maintains the obstructing device in position during actuation of other hydraulically actuated mechanisms. The seated obstructing device (not shown) prevents the flow of fluid through the downhole tool 100. Accordingly, a pressure differential between the upper assembly (not shown) and the lower assembly (not shown) is created. Fluid may then flow upward and into channels (not shown) for providing fluid flow to hydraulically actuated mechanisms (e.g., a liner hanger).

Figure 9:
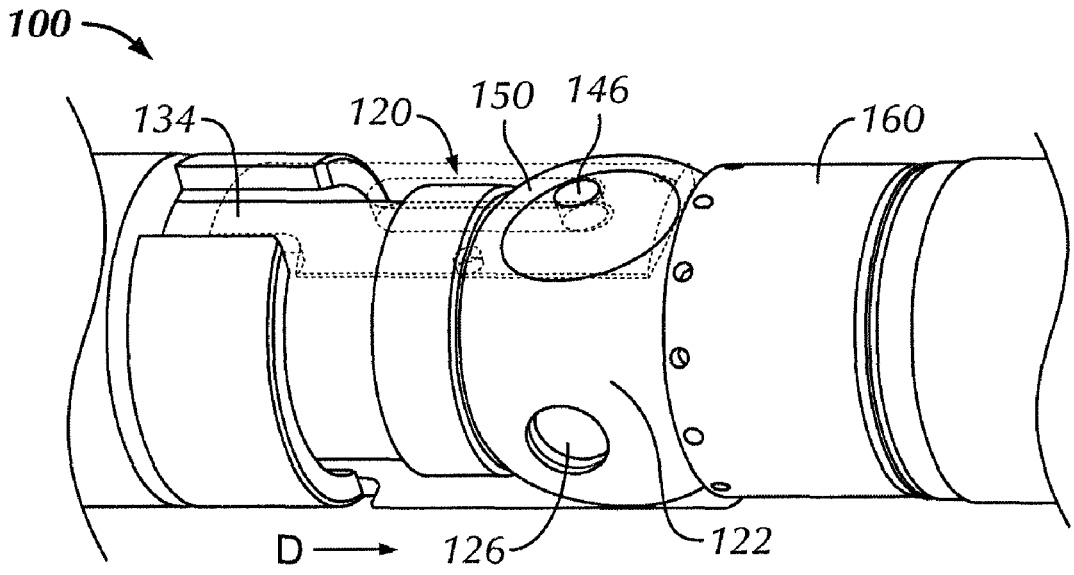
FIG. 9 is a perspective view of an actuator member and camming device in a second position in accordance with embodiments of the present disclosure.
Figure 10:
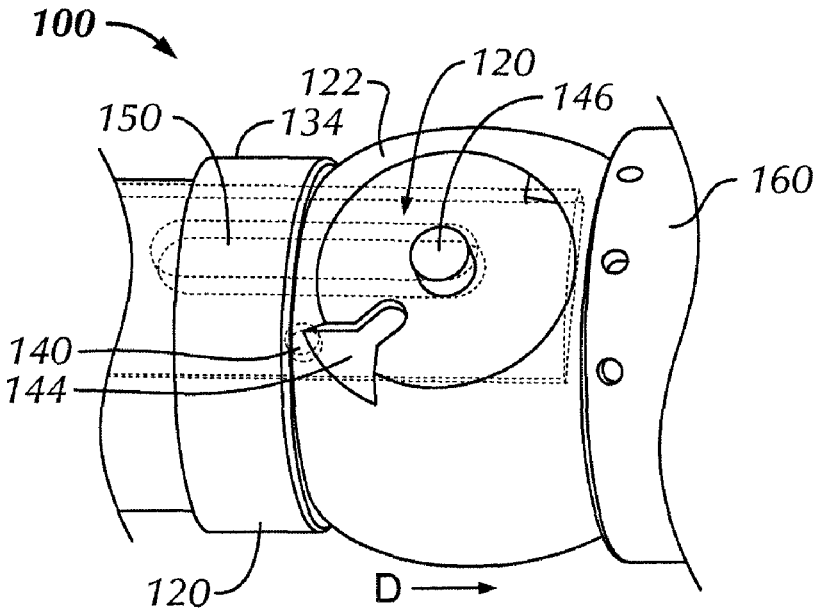
FIG. 10 is close-up perspective view of the actuator member and camming device of FIG. 9.

After actuation of at least one hydraulic mechanism, fluid flow through the central flowbore 114 may be restored by activation of actuator member 122. The actuator member 122 may be hydraulically activated by increasing the fluid pressure above the actuator member 122 acting on the seated obstructing device (not shown). The pressure differential created by the restricted fluid flow across the actuator member 122 provides a force on the sliding sleeve assembly 160. When the force on the sliding sleeve assembly exceeds the predetermined value, or shear value, of the frangible connection (not shown), the frangible connection (not shown) breaks. For example, in the embodiment where the frangible connection (not shown) includes at least one shear pin, the shear pins shear when the force acting on the sliding sleeve assembly 160 exceeds the shearing strength of the at least one shear pin. When the frangible connection (not shown) is broken, the sliding sleeve assembly 160 moves downwardly (indicated at D), thereby allowing the actuator member 122 to move downward and rotate due to engagement of the camming device 120, as discussed in more detail below. As the actuator member 122 moves downwardly, it rotates from the first position (i.e., closed position) (FIGS. 7 and 8) to the second position (i.e., open position) (FIGS. 9 and 10).

The camming device 120 allows the actuator member 122 to rotate from the first position (FIGS. 7 and 8) to the second position (FIGS. 9 and 10) around an axis of rotation (not shown) perpendicular to a central longitudinal axis of the downhole tool 100. When corresponding camming slots 144 of the actuator member 122 engage camming pins 140 as the actuator member 122 is moving downwardly (indicated at D), a torque is imparted to the actuator member 122 that causes it to rotate 90 degrees from the first position to the second position. Protrusions 146 engaged with holding grooves 150 of sliding sleeve 134 guide the actuator member 122 downward as the actuator member 122 rotates. The stop mechanism (not shown) may be positioned between 45 degrees and 180 degrees from the camming slots 144 to prevent over-rotation of the main ball and obstruction of the bore.

Embodiments disclosed herein may provide improved downhole tools and/or improved techniques for hydraulically activating downhole tools. In particular, embodiments disclosed herein may provide a more reliable setting tool for setting hydraulic liner hangers. The downhole tool and method disclosed herein may advantageously provide a multi-functional tool capable of setting liner hangers, while also providing an unobstructed path through the setting tool that may allow the passage of other tools, for example, cement wipers. Also, advantageously, the hydraulic liner hanger may be set and the liner cemented in a single operation. The tool may also advantageously be used for setting casing or isolation packers attached to the liner, or other mechanisms as desired. The downhole tool and method are especially useful in a deviated wellbore or horizontal wellbore, because the features disclosed herein may provide the ability to securely seat a drop ball within an actuator member, without the need for performing extraneous steps to properly seat the ball. Particularly, embodiments disclosed herein advantageously provide ball seat location within an actuator member, which has a natural centering effect provided by an internal concave surface guides the drop ball into the seat. Further, embodiments disclosed herein do not require collet mechanisms, which often damage elastomers, plugs, or darts run through the tool.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A downhole tool for providing a pressure differential between sub-assemblies comprising:
- an elongated body;
- a tubular assembly disposed within the elongated body, the tubular assembly comprising:
  - a central flowbore with an inner diameter, and
  - a central longitudinal axis;
- a camming device;
- an actuator member located below the tubular assembly, having a dual-bore configuration, the actuator member comprising:
  - a first bore;
  - a second bore; and
  - a concave seating surface formed within the first bore for receiving an obstructing device,
  - wherein the first bore and the second bore are oriented 90 degrees to one another so that fluid may flow through the actuator while it is in either a first or a second position; and
- a stationary sleeve concentrically disposed between the actuator member and the elongated body.

2. The downhole tool of claim 1, wherein the camming device connects the actuator member to the stationary sleeve, wherein the actuator member is configured to rotate from the first position to the second position around an axis of rotation perpendicular to the central longitudinal axis.

3. The downhole tool of claim 1, wherein the obstructing device is a drop ball.

4. The downhole tool of claim 2, wherein the camming device comprises:
- a plurality of inwardly facing camming pins disposed on an inner surface of the stationary sleeve;
- a plurality of corresponding cam slots disposed within the actuator member for slidably engaging the plurality of camming pins;
- a plurality of outwardly facing protrusions oppositely disposed on an exterior of the actuator member; and
- a plurality of holding grooves disposed within the stationary sleeve for mating with the protrusions.

5. The downhole tool of claim 1, wherein the first bore further comprises:
- an upper portion having a first inner diameter substantially equivalent to the inner diameter of the central flowbore;
- a transition portion; and
- a lower portion having a tapered inner diameter that tapers inwardly at an angle to form the seating surface.

6. The downhole tool of claim 1, wherein the first bore further comprises:
- an upper portion having a first inner diameter substantially equivalent to the inner diameter of the central flowbore;
- a conical transition portion; and
- a lower portion having a tapered inner diameter that tapers inwardly at an angle to form the seating surface.

7. The downhole tool of claim 1, wherein the concave seating surface is conical.

8. The downhole tool of claim 2, wherein the downhole tool further comprises:
- a sliding sleeve disposed within the elongated body and located below the actuator member, and
- a frangible connection configured to secure the actuator member in the first position.

9. The downhole tool of claim 8, wherein the frangible connection comprises a shearing device.

10. The downhole tool of claim 9, wherein a pressure differential caused by the obstructing device creates a force on the sliding sleeve that exceeds a predetermined set point of the shearing device.

11. The downhole tool of claim 1, wherein the elongated body further comprises:
- a first cylindrical housing in contact with a lower portion of an upper sub, wherein an energizer is disposed concentrically between the first cylindrical housing and a portion of the tubular assembly;
- a second cylindrical housing; and
- a coupler for coupling the first housing to the second housing.

12. The downhole tool of claim 11, wherein the tubular assembly further comprises:
- a shoulder; and
- a lower end in contact with an upper surface of the actuator member,
- wherein the energizer comprises a spring configured to exert a downward force on the shoulder.

13. The downhole tool of claim 4, wherein the actuator member further comprises:
- a mechanical stop configured to prevent over-rotation of the actuator member.

14. A method of operating a downhole tool for providing a pressure differential between sub-assemblies, the method comprising:
- running a setting tool downhole tool to a desired location in a wellbore, the downhole tool comprising:
  - an elongated body;
  - a tubular assembly disposed within the elongated body, the tubular assembly further comprising:
    - a central flowbore with an inner diameter, and
    - a central longitudinal axis;
  - a camming device;
  - an actuator member having a dual-bore configuration, the actuator member further comprising:
    - a first bore;
    - a second bore;
    - a concave seating surface formed within the first bore for receiving an obstructing device; and
  - a stationary sleeve disposed between the actuator member and the elongated body, wherein the actuator member is aligned axially in a first position and located below the tubular assembly;
- circulating a fluid through the central flowbore;
- disposing the obstructing device into the fluid,
  - wherein the fluid guides the obstructing device into the seating surface; and
- providing a pressure differential between an upper sub and a lower sub to activate the downhole tool.

15. The method of claim 14, wherein the camming device connects the actuator member to the stationary sleeve, wherein the actuator member is configured to rotate from the first position to a second position around an axis of rotation perpendicular to the central longitudinal axis.

16. The method of claim 14, wherein the second bore further comprises:

an upper portion having a first inner diameter substantially equivalent to the inner diameter of the central flowbore;

a transition portion; and a lower portion having a tapered inner diameter that tapers inwardly at an angle to form the seating surface.

17. The method of claim 16, wherein the downhole tool further comprises:

a sliding sleeve disposed within the elongated body and located below the actuator member, and a frangible connection configured to secure the actuator member in the first position.

18. The method of claim 14, comprising the further steps of:

actuating a second downhole tool.

19. The method of claim 18, wherein the second downhole tool is a liner hanger.

20. The method of claim 14, wherein the method further comprises the steps of:

increasing a pressure of the fluid in the central flowbore; and rotating the actuator member from the first position to a second position.

* * * * *